US005911386A

United States Patent [19]

Martin

[11] Patent Number: 5,911,386

[45] Date of Patent: Jun. 15, 1999

[54] RIBBON GUIDE METHOD AND APPARATUS

[75] Inventor: John R. Martin, Rockford, Ill.

[73] Assignee: Martin Automatic, Inc., Rockford, Ill.

[21] Appl. No.: 08/915,504

[22] Filed: Aug. 14, 1997

[51] Int. Cl.[6] ..... B65H 57/18; B65H 18/08

[52] U.S. Cl. ..... 242/566; 242/471; 242/615.21

[58] Field of Search ..... 242/566, 563.1, 242/564, 615.1, 615.2, 615.21, 471, 128, DIG. 2

[56] References Cited

U.S. PATENT DOCUMENTS

| | | | |
|---|---|---|---|
| 2,417,818 | 3/1947 | Finn | 242/615.1 X |
| 2,592,090 | 4/1952 | Weaver | 242/615.1 X |
| 3,305,153 | 2/1967 | Keding et al. | 242/615.1 X |
| 4,003,525 | 1/1977 | Podvin et al. | 242/564 X |
| 4,410,122 | 10/1983 | Frye et al. | 242/615.2 |
| 4,441,664 | 4/1984 | Stohlquist | 242/566 X |
| 4,627,584 | 12/1986 | Kuhn et al. | 242/566 X |
| 4,669,646 | 6/1987 | Oinonen | 242/615.2 X |

*Primary Examiner*—Michael Mansen
*Attorney, Agent, or Firm*—McAndrews, Held & Malloy, Ltd.

[57] ABSTRACT

Relatively narrow width, relatively fragile ribbon is payed off of a traverse wound, relatively much larger width core and is guided over a bar, which has a concave, smoothly curved surface, so as to minimize back and forth, side to side wandering of the ribbon as the ribbon is being payed off the core. The curved surface of the bar includes a number of roller bearings that are mounted side by side on the bar and that serve to minimize friction as the ribbon is guided and passed over the curved surface of the bar.

6 Claims, 2 Drawing Sheets

RIBBON GUIDE METHOD AND APPARATUS

BACKGROUND OF THE INVENTION

The present invention relates to guiding a ribbon that is being payed off of a core; and more particularly, to a method and apparatus for guiding a relatively narrow, relatively fragile ribbon that is being payed off of a transverse wound core.

In the past, relatively narrow width, relatively fragile ribbons have been transverse wound on cores that have widths substantially greater than that of the ribbons. An example of such a ribbon is a non-woven web used in the manufacture of disposable diapers. When such ribbons are payed off of their cores, the ribbons have had a tendency to wander, back and forth, from side to side. Such wandering is disadvantageous and detrimental to efficient operation of the initial downstream ribbon handling processor or apparatus, such as, for example, a ribbon splicer, that preferably needs to have the ribbon continuously enter the splicer at the same lateral position.

Those working in this art have for sometime been seeking an inexpensive, reliable way to prevent or minimize the wandering of such ribbons as the ribbon is pulled from a transverse wound core.

SUMMARY OF THE INVENTION

In its principal aspects, my invention affords an inexpensive and efficient way to guide a relatively fragile, relatively narrow, unwinding ribbon so as to minimize the back and forth, side to side wanderings of the ribbon as it is payed off of its transverse wound core. The improved method and apparatus of my invention permit such a guided ribbon to be payed off the core at a relatively high speed, for example 200 feet per minute or more, while assuring that the ribbon will enter the initial downstream ribbon processor at the desired preselected lateral position.

Accordingly, it is a primary object of my present invention to provide an improved method and apparatus for guiding a ribbon being unwound from a transverse wound core, where the ribbon has a predetermined width and may be damaged if pulled with a force in excess of a predetermined tearing force, where the core has a predetermined width and a longitudinal axis, where the width of the ribbon is relatively narrow with respect to the width of the core, and where the ribbon runs along a preselected path of travel from the core to an initial ribbon handling process or apparatus after being payed from the core.

Another object of the present invention is to provide an improved method for guiding the unwinding ribbon, as described, where the method includes the steps of paying the ribbon off of the core and along the preselected path by pulling the ribbon with a force less than the predetermined excessive tearing force; and then guiding the unwinding ribbon over a curved, smooth surface as the ribbon runs along a portion of the preselected path so as to minimize back and forth, side by side wandering of the ribbon as the ribbon is payed off the core. A related object of the present invention is to provide an improved method, as described, where the ribbon is guided over means, which is a part of the curved surface, so as to reduce friction between the ribbon and the curved surface as the ribbon passes over the curved surface; and where the ribbon is guided over the curved surface in a direction substantially transverse to the plane of the surface. Still another related object of the present invention is to provide an improved method, as described, where the ribbon is guided over a bar that includes a concave, smoothly curved surface and where a plurality of roller bearings are mounted, side by side, on the curved surface of the bar to reduce the friction between the ribbon and the curved surface as the ribbon passes over the curved surface.

Still another object of the present invention is to provide an improved apparatus for guiding the unwinding ribbon from a rotatable, transverse wound core, as described, where the apparatus includes a means for supporting the ribbon wound core for rotation about the rotational axis of the core, means for pulling the ribbon from the rotating core with a force less than the predetermined force so that the ribbon is payed off of the core and runs along the preselected path, and means adjacent to a portion of the preselected path, for guiding the unwinding ribbon so as to minimize back and forth, side to side wandering of the ribbon as it is payed off of the core and runs along the preselected path. A related object of the present invention is to provide an improved apparatus, as described, where a curved surface is disposed so that the ribbon is guided over the curved surface as the ribbon runs along a portion of the predetermined path, and where the plane of the curved surface is substantially transverse to the portion of the predetermined path. Still another related object of the present invention is to provide an improved apparatus, as described, where the curved surface is a bar includes a concave, smoothly curved portion that has a preselected radius of curvature; and where means for reducing friction are mounted on the curved surface, between the ribbon and the curved surface, as the ribbon passes over the curved surface. A still further related object of the present invention is to provide an improved apparatus, as described, where the friction reducing means includes a plurality of roller bearings mounted, side by side, on the curved portion of the bar.

These and other objects, advantages and benefits of my invention will become apparent from the following description of the preferred embodiment of my invention, which description will be made in conjunction with the following drawings.

DETAILED DESCRIPTION OF THE INVENTION

Figure 1:
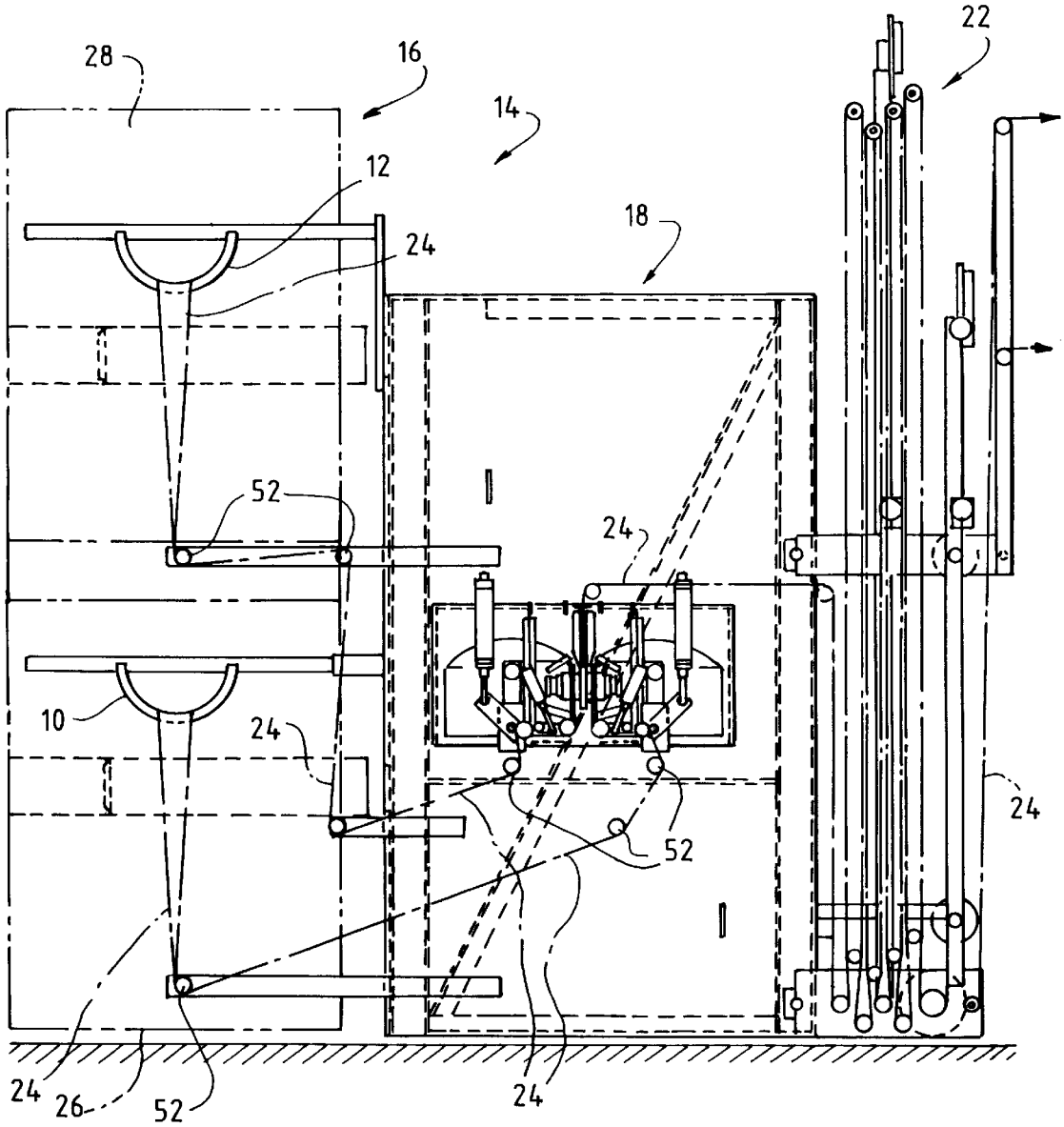
FIG. 1 is a partial, front elevational view showing a ribbon or web handling assembly that includes my invention.
Figure 2:
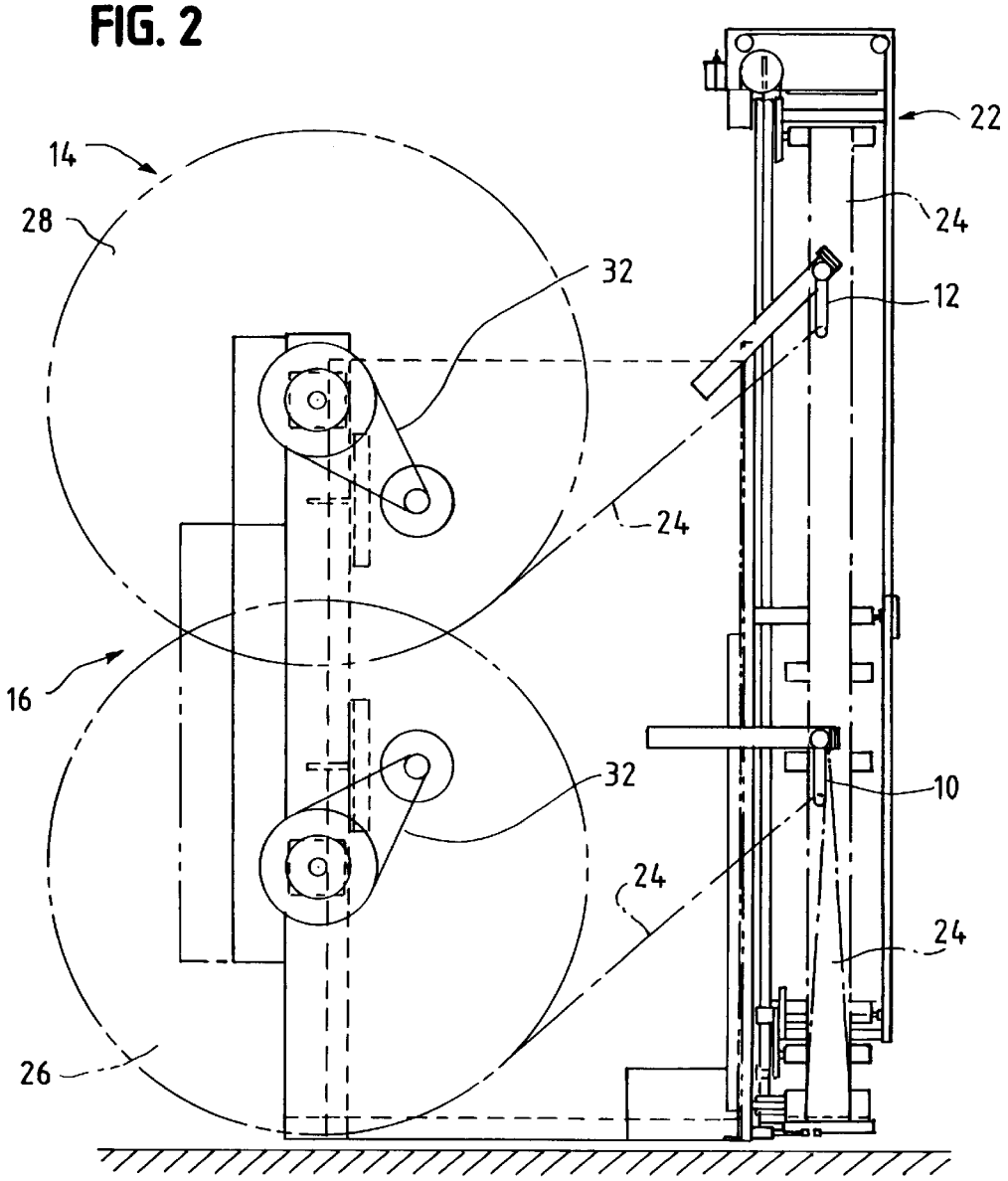
FIG. 2 is a side elevational view of the assembly of FIG. 1.

Referring now to FIGS. 1 and 2, the preferred embodiment of web guides 10 and 12 for my invention are shown mounted for use with an otherwise conventional web handling assembly, illustrated generally at 14. The assembly 14 includes a roll stand subassembly 16, a splicer subassembly 18, and a festoon subassembly 22. The assembly 14 is designed and intended to handle relatively narrow width ribbons or webs 24 that tends to be relatively fragile, that is, that tends to readily tear or otherwise be damaged if pulled with a force in excess of a predetermined tearing force. For example, the ribbon 24 may be a nonwoven web, such as used in the manufacture of disposable diapers.

In anticipation of being handled by, or more specifically, run through the assembly 14, the ribbon 22 is transverse wound on a relatively large width core, not shown. The ratio of the width of the core to the width of the ribbon 24 is at least 15 to 1 and may be 20 to 1 or even more. Those working in the art will recognize that when transverse wound, the ribbon is laid onto the core in layers, with each layer having a thickness equal to the thickness of the ribbon. In the first, radially innermost layer, the ribbon is wound, starting adjacent to a first end of the core and then proceeding across the core to its other or second end. In the next layer, the ribbon is wound on the core, starting at the second end and proceeding to the core's first end. The layering continues, back and forth, from end to end (or side to side) until a relatively large radius roll of ribbon has been wound.

The ribbon 24 is brought to the assembly 14 in such large rolls. Two of such rolls are shown by dotted lines, at 26 and 28 in FIGS. 1 and 2, mounted on the roll stand subassembly 16. While FIGS. 1 and 2 show the two rolls 26 and 28 mounted on the roll stand subassembly 16, in practice, only one full roll is mounted on the subassembly 14 at any one time. And the full roll is only mounted as the other roll is expiring so that there is no interference between the rolls when they are mounted on the subassembly 14 and when ribbon 24 is being payed off of one of the rolls. In other words, a full roll 26 is mounted on the subassembly 16, for example, at the lower position, and ribbon 24 is payed off of that roll and along its preselected path of travel through the rest of the assembly 14 and beyond. As that roll expires, another full roll 28 is mounted on the subassembly, for example, at the upper position and the leading end of its ribbon is prepared for splicing. When the roll 26 is fully expired and the leading end of the ribbon from roll 28 has been spliced onto the trailing end of the ribbon from in the splicer subassembly 18, the core (including any remaining ribbon) of the roll 26 is removed from the subassembly 16 and a new full roll is positioned in its place as the roll 28 in turn expires.

Each of the rolls 26 and 28, when mounted on the subassembly 16 may be rotated by a conventional motor-brake subassembly 32 to facilitate the paying off of the ribbon 24 from the roll. As the ribbon 24 is being unwound and pulled from a roll 26 or 28, it passes over the web guide assembly 10 or 12 associated with the running roll that is, disposed adjacent to the path of travel of the ribbon as it runs from that roll to the splicer subassembly 18. In this regard, assembly 10 is shown associated with the lower roll 26 while the web guide assembly 12 is shown associated with the upper roll 28. Both the web guide assemblies 10 and 12 are structurally and functionally identical and only assembly 10 will be described in detail hereinafter. After the ribbon passes through its respective web guide assembly 10 or 12, it then enters the splicer subassembly 18 which may be of any conventional design. As is conventional, the splicer subassembly 18 is intended to and does splice the trailing end of the expiring or depleting roll with the leading end of the new, full roll of ribbon mounted on the subassembly 16.

After the ribbon 24 passes through the splicer subassembly 18 it then proceeds along its preselected path of travel to and through the festoon subassembly 22. The design and function of this subassembly 22 are conventional. Hence as will be recognized by those skilled in the art, the festoon subassembly 22 permits the running ribbon to be stopped, during the splicing operation in the subassembly, without effecting web handling operations which are occurring downstream from the assembly 14.

As noted above, the ribbon 14 is transverse wound on the core much like a fishing line is wound on a reel. Because of this, when the ribbon 24 is payed off of the core, it tends to wander, back and forth, from side to side. This presents a problem as the ribbon enters the splicer subassembly 18 in that subassembly 18 functions better when the ribbon enters at predetermined lateral position. Such side to side, back and forth wandering of the ribbon 24 is effectively eliminated by passing the ribbon over the guide assembly 10 or 12 associated with the roll from which the ribbon is being payed.

Figure 3:
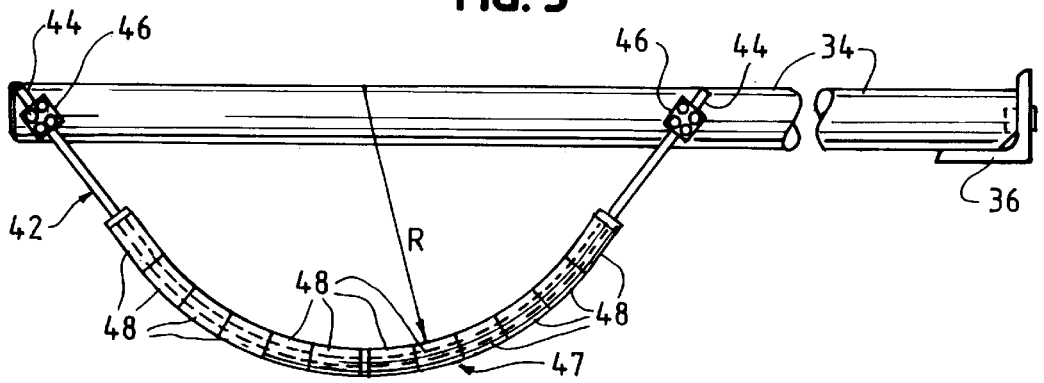
FIG. 3 is an enlarged, side elevational view showing the ribbon guiding of my present invention mounted on the web unwinding apparatus of FIGS. 1 and 2.

As best shown in FIG. 3, the guide assembly 10 is mounted on a member 34 that projects generally horizontally from the support frame 36 for the assembly 14. The guide assembly 10 includes a smoothly, concavely, curved bar 42. The ends 44 of the bar 42 are secured, by means of a conventional brackets 46 to the member 34. So that the concave curved portion 47 of the bar 42 is adjacent to the path of travel of the ribbon 24 as it is payed off of the roll 26, so that the plane of the bar is perpendicular to the path of travel and so that the curve portion 47 is disposed below (lower than) the ends 44 of the bar. A plurality of conventional roller bearings 48 are mounted for rotation on the bar 42. The bearings 48 have smooth, continuous, rotatable cylindrical outer housings and are designed so that their housing may rotate freely about the longitudinal axis of the bar 42. The bearings 48 are mounted side by side on the curved portion 47. The ribbon passes over and about the roller bearings 48, and because of the rollers, there is a minimal friction induced between the ribbon and the bar 42 as the ribbon is pulled over the guide assembly 10. The total length of the bearings 48 is greater than the anticipated side by side movement of the ribbon 24 as it is payed off of its roll.

After passing over the guide assembly 10, the ribbon 24 continues over several conventional rolls 52 that guide the ribbon into the splicer subassembly 18. However, by reason of passing over the guide assembly 10, the ribbon 24 essentially maintains a fixed predetermined lateral position as it passes over these rolls 52 so that the ribbon may enter the splicer subassembly 14 in the desired preselected lateral position.

As noted above, the speed at which the ribbon 24 may be pulled from the core may be at least 200 feet per minute. Under these circumstances, it has been found that when the curved portion 47 of the bar 42 has a radius for curvature as indicated at "R" in FIG. 3, of approximately 8½ inches, virtually all side to side, back and forth movement of the ribbon will be eliminated after the ribbon has passed over the guide assembly.

I claim:

1. An improved method for minimizing the back and forth side to side wandering of a relatively fragile ribbon after the ribbon is unwound from a rotatable, ribbon wound core and as the ribbon is run downstream from the rotatable core at a preselected speed, where the ribbon has a predetermined width and may be damaged if pulled with a force in excess of a predetermined tearing force, where the core has a predetermined width and has a longitudinal axis, where the width of the ribbon is relatively narrow with respect to the width of the core, where the ribbon is traverse wound on the core, and where the ribbon runs along a preselected path of travel from the core to an initial ribbon handling/processing assembly after being unwound from the core, the improved method comprising the steps of:

paying the ribbon off of the core and running the unwinding ribbon along the preselected path with a force of less than the predetermined excessive tearing force of the ribbon; and guiding the ribbon over the outer surface of one or more of a plurality of freely rotatable roller bearings, which are mounted, side-by-side, on a curved bar, as the ribbon runs along a portion of the preselected path so as to minimize back and forth, side to side wandering of the unwinding ribbon, with respect to the predetermined path, as the ribbon runs along the preselected path at the preselected speed downstream from the curved bar.

2. The improved method of claim 1 further comprising the step of guiding the ribbon over the outer surface of one or more of the plurality of roller bearings in a direction substantially transverse to the plane of the curved bar.

3. The improved method of claim 2 where the ratio of the width of the core to the width of the ribbon is at least 20 to 1; where the preselected speed is at least 200 feet per minute; where the curve of the bar is concave with respect to the portion of the preselected path adjacent to the bar; and where the plane of the curved bar is disposed substantially parallel to the longitudinal axis of the core when the ribbon is guided over the bar, with the curved bar having a radius of curvature of approximately eight and one half inches.

4. An improved apparatus for minimizing the back and forth, side by side wandering of a relatively fragile ribbon after the ribbon is unwound from a rotatable, ribbon wound core and as the ribbon is run downstream from the rotatable core at a preselected speed, where the ribbon has a predetermined width, where the core has a predetermined width, where the width of the ribbon is relatively narrow with respect to the width of the core, where the ribbon is traverse wound on the core, where the ribbon will be damaged if pulled with a force in excess of a predetermined tearing force, and where the ribbon runs along a preselected path of travel from the core to an initial ribbon handling/processing assembly, the improved apparatus comprising:

means for supporting the ribbon wound core for rotation about the longitudinal axis of the core;

means for paying the ribbon from the rotating core with a force of less than the predetermined tearing force of the ribbon so that the ribbon may run along the preselected path of travel at the preselected speed; and a ribbon guiding surface that includes the outer surface of one or more of a plurality of freely rotatable roller bearings, which are mounted, side-by-side, on a curved bar, and that is disposed adjacent to a portion of the preselected path of travel of the ribbon so that the ribbon is guided over the ribbon guiding structure as the ribbon runs along the portion of the preselected path of the travel so as to minimize back and forth, side to side wandering of the ribbon, with respect to the preselected path of travel, as the ribbon runs along the preselected path of travel downstream from the ribbon guiding structure.

5. The improved apparatus of claim 4 wherein the plane of the curved bar is substantially transverse to the portion of the path of travel of the ribbon; wherein the ratio of the width of the core to the width of the ribbon is at least 15 to 1; and wherein the curve bar is concave with respect to the portion of the predetermined path.

6. The improved apparatus of claim 5 wherein the ratio of the width of the core to the width of the ribbon is at least 20 to 1; wherein the preselected speed is at least 200 feet per minute; and wherein the curved bar has a radius of curvature of approximately eight and one half inches.

* * * * *